United States Patent [19]

Walthall

[11] Patent Number: 4,706,592

[45] Date of Patent: Nov. 17, 1987

[54] STEERING ARM FOR OUTBOARD MOTORS

[75] Inventor: B. Kenneth Walthall, Arlington, Tex.

[73] Assignee: Molded Parts Specialists, Arlington, Tex.

[21] Appl. No.: 903,783

[22] Filed: Sep. 5, 1986

[51] Int. Cl.[4] ..... B63H 25/00

[52] U.S. Cl. ..... 114/153; 440/7

[58] Field of Search ..... 440/6, 7, 63, 113, 900; 114/153, 144 R, 144 A; 74/480 B, 478, 479, 512, 515

[56] References Cited

U.S. PATENT DOCUMENTS

| | | | |
|---|---|---|---|
| 3,288,099 | 11/1966 | Bittner | 114/153 |
| 3,420,203 | 1/1969 | Ambrosh | 114/153 |
| 4,569,663 | 2/1986 | Miller et al. | 440/7 |

*Primary Examiner*—Joseph F. Peters, Jr.
*Assistant Examiner*—Jesûs D. Sotelo
*Attorney, Agent, or Firm*—Harold H. Dutton, Jr.

[57] ABSTRACT

A steering arm for outboard motors comprising an elongate arm body member having a pair of vertical side web portions extending substantially the full length of the body member and a central horizontal web portion; the body member has a clamping means integrally formed at one end thereof and inludes a thickened boss having a semi-circular cutout formed in the free end thereof; a cooperating clamp member has a semi-circular cutout complementary to the cut-out in the body member so that cut-outs substantially surround a motor support shaft, and means are provided for securing the clamp member to the body member; the vertical side webs are angled downwardly in their vertical plane at the other end of the arm body member, and an opening is provided in the central horizontal web portion adjacent the downwardly angled side web portions and together with reinforcing means traversing the opening and integral with the central horizontal web form a foot support; and a vertical reinforcing web connecting said boss and said central horizontal web is provided.

5 Claims, 3 Drawing Figures

STEERING ARM FOR OUTBOARD MOTORS

This invention relates to a steering arm for outboard motors. More particularly, the invention relates to a new steering arm for electric outboard motors which may be steered either by hand or by foot.

BACKGROUND AND OBJECTS OF THE INVENTION

Small outboard motors, either electric or gasoline powered, are commonly used on small boats as the sole source of propulsion. Even many sail boats use a small outboard motor as an auxiliary power source. On many fishing boats with large internal combustion engines, a small outboard motor is also used to provide maneuverability while fishing, without starting the large internal combustion motor. Such auxiliary motors are quite common in the boating industry.

A particularly popular type of outboard motor for use as an auxiliary motor is an electric motor which typically is powered by auxiliary batteries carried on the boat. Thus, the fisherman can use a large, high horsepower, internal combustion engine to get from place to place quickly, while retaining a high degree of maneuverability during fishing. Such electric outboard motors offer the additional advantage of being very quiet in operation and very easily used.

Typically, electric type outboard motors are of two different types. One type uses a bracket which is bolted or clamped to the deck or transom of the boat, and mounts a shaft which in turn carries the motor on one end. The bracket provides a pivot mechanism by which the shaft, and the motor, may be retracted to a stowed position, in which position the shaft is essentially horizontal so that the motor is up and out of the water. In a lowered position, the shaft is essentially vertical and the motor is submerged into the water for use. The steering of such motors is accomplished by rotating the direction of thrust of the motor, by turning the shaft in its mounting bracket.

In the second type of motor, a foot pedal is provided which is connected to a gear mechanism in the upper portion, or "head", of the shaft by a cable, so that operating the foot pedal will turn the motor and shaft in one direction or another to change the direction of thrust and steer the motor. The foot pedal may also house ON/OFF and speed control switches. Such an arrangement is termed a "foot control" motor.

In another arrangement, which is generally less expensive, no foot pedal, cable or gear mechanism is provided and the motor support shaft is simply supported for rotation in the mounting bracket. A handle is often provided to extend from the upper end of the shaft or the "head" and the handle is used manually to turn the shaft and steer the motor in the direction desired. In this case, the ON/OFF and speed control switches are usually mounted in the "head". Such motors are known as "hand controlled" motors.

Because of their lower cost, and in some cases their greater maneuverability, the hand controlled motors are preferred by some fishermen over the foot controlled motors. Nevertheless, the hand controlled motors are often more tiring to use, especially if they are to be steered "by hand" instead of by foot. Further, the use of ones hands to steer the motor can be an awkward exercise while holding a fishing rod and/or fighting a fish.

For this reason, many fisherman who use a hand control motor end up using their foot to "kick" the handle to the desired direction while continuing to fish. Ordinarily the mounting brackets used on hand controlled motors have sufficient friction that the motor will stay in the direction desired without the need to continue holding the handle. By contrast, the foot controlled motors generally are more friction free, and the shafts or these motors, and thus the thrust direction, will turn in reaction to the torque and thrust of the motor.

However, the handles of the hand controlled motors in the past have been designed, for the most part, to be steered by hand, and not by foot. For this reason, the control switches are often placed on the top of the housing, and the use of one's foot is likely to break the switches. Similarly, the handles too are likely to break if the user rests his foot on the handle while steering with the foot.

Accordingly, a primary object of this invention is to provide an improved steering arm for outboard motors.

Another object of this invention is to provide a steering arm for outboard motors which may be operated by the foot of the user, without damage to the rest of the motor.

Still a further object of the invention is to provide a steering arm for outboard motors which may be added to a outboard motor without interfering with the installation of the motor on the boat.

Yet another object of the invention is to provide a steering arm for outboard motors which has sufficient strength to be capable of foot use, and is of a shape as to be capable of use by hand as well.

Yet a further object of the invention is to provide a light-weight, improved steering arm for outboard motors of the electric type which overcomes the disadvantages of prior steering controls for hand controlled outboard motors.

These and other objects and advantages of this invention will become apparent upon consideration of the following description of the invention when taken together with the accompanying drawings.

DESCRIPTION OF THE DRAWINGS

The present invention is shown in detail in the accompanying drawings in which.

DESCRIPTION OF THE INVENTION

The steering arm according to the present invention comprises a handle body having a clamp at one end thereof for attachment to the motor supporting shaft of a conventional electric outboard motor. The clamp is such that one half has a semi-circular cut-out portion integrally formed in the handle body and the other half comprises a cap member having a semi-circular cut-out portion formed therein. Fastening means are provided for securing the cap member to the handle body with the two semi-circular cut-outs surrounding the motor support shaft and clamping the two semi-circular portions together around the shaft for securing the steering arm to the motor support shaft.

The other end of the steering arm is effectively cantilevered from the motor support shaft, and includes a foot contacting portion at the distal end. The steering arm is preferably formed one piece of molded plastic for light weight and strength, and to meet the objectives of light weight and good strength, the arm includes a horizontal central web over a portion of the length of the steering arm and vertical side webs, extending the full length of the arm. Shorter, central webs, both vertical and horizontal, are also provided at stress points for strength. The distal end of the steering arm is downturned at a slight angle to provide a comfortable foot support.

Optionally, the foot support is cut-out in such a manner as to provide a stirrup into which the foot of the user may be inserted. Also, optionally, the foot support portion of the steering arm may be provided with switches for turning the motor on or off.

DETAILED DESCRIPTION OF PREFERRED EMBODIMENTS

Figure 1:
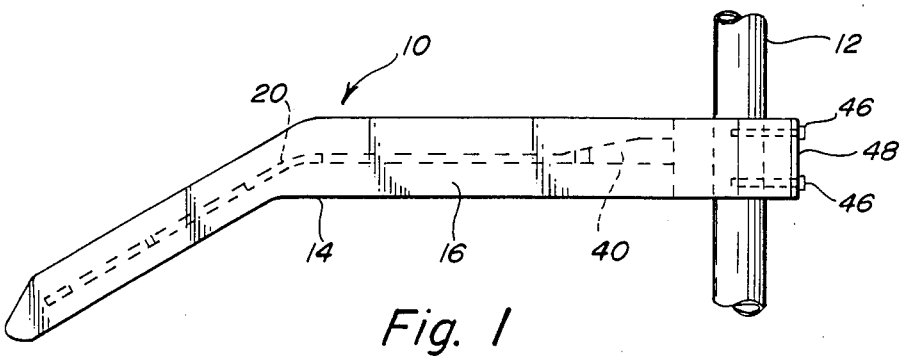
FIG. 1 is a side elevation view of the steering arm according to this invention.
Figure 2:
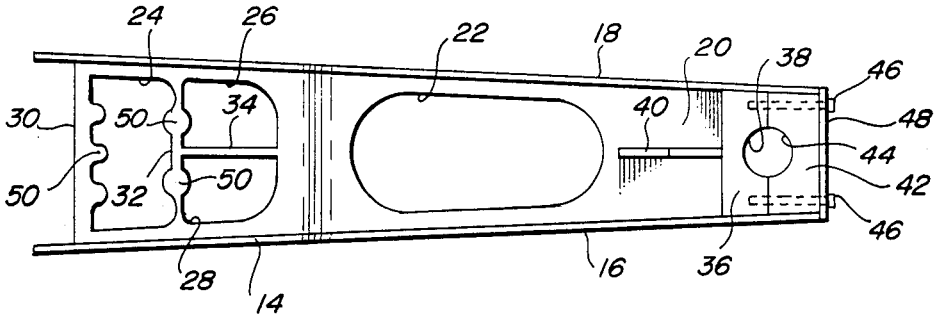
FIG. 2 is a top plan view thereof.

Referring to FIGS. 1 and 2, the steering arm generally designated 10 is shown attached to a motor support shaft 12 which extends downwardly to the motor head which carries a propeller (not shown) in a conventional manner. By rotating this shaft 12, the angular position of the motor head and the direction of thrust of the motor is changed to steer the boat.

The steering arm 10 is seen to include a body portion 14 which may be made of molded plastic or composite material, or cast metal, for example, and includes a pair of vertical web portions 16 and 18 and a horizontal web portion 20 which extends between the two vertical web portions. The vertical web portions 16 and 18 extend the full length of the steering arm 10, while the horizontal web portion 20 extends over a major portion of the arm 10.

The horizontal web portion is provided with cut-out portions in order to reduce the weight of the steering arm. A large, oval cut-out 22 is provided near the middle of the arm 10. The transverse axis of the cut-out 22 is shorter than the distance between the vertical web portions 16 and 18 so that a portion of the horizontal web 20 remains along both sides of the cut-out 22, as seen in FIG. 2. This arrangement provides both good strength and light weight.

At the left end of the arm 10 as seen in FIG. 2, a series of cut-outs 24, 26 and 28 are provided, the transverse reinforcing ribs 30 and 32 are thereby formed. A further reinforcing rib 34, longitudinally positioned, is also thereby formed between the cut-outs 26 and 28. These reinforcing ribs 30, 32 and 34 additionally form a surface in the nature of a pedal upon which the user may place his foot, when steering the motor by rotating the steering arm 10 and the support shaft 12 in the mounting bracket (not shown) of the motor.

At the motor support shaft end of the steering arm, i.e. the right side as shown in the drawings, an integral boss 36 is molded. This boss 36 has a substantial thickness, essentially the same as the height of the vertical webs 16 and 18, and also is provided with a semi-circular recess 38 which is adapted to fit around the motor support shaft 12. Most commercially available electric outboard motors have a shaft diameter of 1 inch, and thus the recess 38 would have a radius of 0.5 inch to accommodate most motors. Clearly, however, the size of this recess may be varied to fit motor shafts of different diameters.

An additional reinforcing rib 40 is molded integrally with the steering arm 10, and lies in a preferably vertical plane, extending from the boss 36 to the central horizontal web 20. This has been found to be a particularly important stress point, and premature failure of the steering arm is likely to occur without this rib 40.

A cap 42 is provided of approximately the same size as the boss 36, and also has a recess 44 of the same size as the recess 38. A plurality of screws of bolts 46 are provided to extend through the cap 42 and into threaded holes in the boss 38. Preferably, a metal reinforcing plate 48 is provided through which the bolts 46 pass, so that upon tightening the bolts 46, the whole steering arm is securely clamped to the motor support shaft 12.

Figure 3:
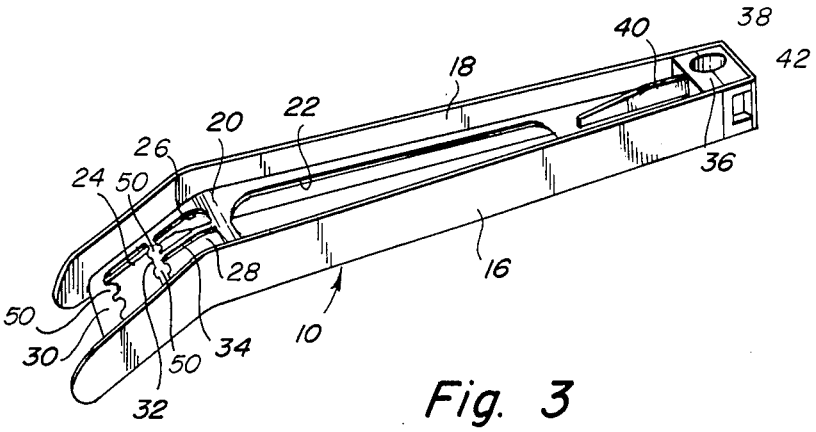
FIG. 3 is a perspective view thereof.

In order to provide a comfortable angle for the user, the distal end of the steering arm 10 is downwardly angled, as seen in FIGS. 1 and 3. The steering arm, by this construction, has sufficient strength for the user to rest his foot on the "pedal" area, without the risk that the arm would break. Then, by simply moving his foot to the side, the motor is steered to the desired direction.

The reinforcing ribs 30 and 32 may be provided with enlarged areas 50. These enlarged areas serve the dual function of enlarging the surface of the "pedal" area, and of providing a mounting surface for electrical switches. For instance, momentary contact or ON/-OFF pushbutton switches may be mounted in these enlarged areas for controlling the outboard motor functions. In this manner, only the contact button of thw switch would project above the foot surface, while the body of the switch would be out of the way beneath this foot surface. The switches then are conveniently mounted for the user to actuate the necessary controls.

While this invention has been described as having certain preferred features and embodiments, it will be clear that the invention is capable of still further variation and modification without departing from the spirit of the invention, and this application is intended to cover any and all variations, modifications, adaptations and alternatives as may fall within the spirit of the invention and the scope of the appended claims.

I claim:

1. A steering arm for outboard motors comprising an elongate arm body member having a pair of vertical side web portions extending substantially the full length of said body member and a central horizontal web portion, said body member having a clamping means at one end thereof and including an integrally formed boss having a semi-circular cutout formed in the free end thereof, a clamp member having a semi-circular cutout complementary to the cut-out in said body member so that said cut-outs substantially surround a motor support shaft and clamp the motor support shaft therebetween, means for securing said clamp member to said body member, said vertical side web portions being angled downwardly in their vertical planes at said other end, and means defining openings and reinforcing ribs in said central horizontal web portion adjacent the downwardly angled ends thereof, and a vertical reinforcing web connecting said boss and said central horizontal web.

2. A steering arm for outboard motors as in claim 1 and wherein said reinforcing ribs and said central horizontal web portion form a foot support.

3. A steering arm for outboard motors as in claim 2 and wherein said central horizontal web portion includes a central cutout extending over a major portion of the length thereof.

4. A steering arm for outboard motors as in claim 2 and wherein said reinforcing ribs include means for mounting electric switches therein.

5. A steering arm for outboard motors as in claim 2 and wherein said fastening means includes bolts, and a reinforcing plate mounted on said clamp member and secured by said bolts.

* * * * *